US005885107A

United States Patent [19]

Sluss et al.

[11] Patent Number: 5,885,107

[45] Date of Patent: Mar. 23, 1999

[54] ELECTRICAL CONNECTION SYSTEM

[75] Inventors: Jay Michael Sluss, Lower Burrell, Pa.; Edward Martin Bungo, Cortland, Ohio; Anthony Joseph Corso, Struthers, Ohio; William T. Madden, Solon, Ohio

[73] Assignee: General Motors Corporation, Detroit, Mich.

[21] Appl. No.: 923,032

[22] Filed: Sep. 3, 1997

[51] Int. Cl.[6] ..... H01R 13/40

[52] U.S. Cl. ..... 439/595; 439/660

[58] Field of Search ..... 439/752, 248, 439/595, 660, 77

[56] References Cited

U.S. PATENT DOCUMENTS

| | | | |
|---|---|---|---|
| 3,154,365 | 10/1964 | Crimmins | 339/176 |
| 3,432,802 | 3/1969 | Ritchie | 339/128 |
| 4,013,331 | 3/1977 | Kobler | 439/595 |
| 4,389,021 | 6/1983 | Coldren | 339/126 R |
| 4,418,975 | 12/1983 | O'Keefe, II | 339/91 R |
| 4,474,420 | 10/1984 | Nestor | 339/17 F |
| 4,812,133 | 3/1989 | Fleak et al. | 439/248 |
| 5,083,939 | 1/1992 | Ittah | 439/496 |
| 5,514,000 | 5/1996 | Krause et al. | 439/248 |
| 5,607,327 | 3/1997 | Tsuji et al. | 439/752 |
| 5,620,329 | 4/1997 | Kidd et al. | 439/348 |

*Primary Examiner*—Gary Paumen
*Assistant Examiner*—Antoine Nganajui
*Attorney, Agent, or Firm*—Cary W. Brooks

[57] ABSTRACT

An electrical connection system for connecting an electrical device mounted on an instrument panel to an electrical circuit located behind the panel including a male plug mounted on the back wall of an instrument panel receptacle and a female socket mounted inside the electrical device adjacent an access hole. The male plug has a nonconductive connector body and a plurality of metal terminals that are retained in terminal cavities by flexible arms that project into tubular contact portions at the forward ends of the terminals. The connector body of the male plug has a platform at the forward end where the terminal cavities have channel shaped portions that have open exterior sides for exposing the tubular contact portions of the metal terminals. The tubular contact portions each include a lock aperture that cooperates with an associated flexible lock arm for retaining the terminals in the terminal cavities. The female socket has a nonconductive connector body and a plurality of compliant metal terminals. Each of the compliant metal terminals has a flexible tongue that projects into the slot for contacting the flat contact surface of a metal terminal of the male plug when the female socket is plugged onto the male plug.

5 Claims, 3 Drawing Sheets

ELECTRICAL CONNECTION SYSTEM

TECHNICAL FIELD

This invention relates generally to an electrical connection system and more particularly to an electrical connection system useful in establishing an electrical connection between a visual or manually operable electrical device mounted on a panel and an electrical circuit that is located behind the panel, for example, connecting a heating, ventilating and air conditioning (HVAC) control module mounted on an automotive instrument panel to an electrical circuit that is located behind the instrument panel.

BACKGROUND OF THE INVENTION

Visual or manually operable electrical devices, such as speedometers, fuel and oil gauges and radio and HVAC control modules, that are mounted on automotive instrument panels are commonly connected to a flexible printed circuit behind the instrument panel.

See for instance, U.S. Pat. No. 5,620,329 granted Apr. 15, 1997, to Richard L. Kidd et al. for a self aligning electrical connective arrangement and assigned to the assignee of this invention. The self aligning electrical connective arrangement of this patent is particularly suitable for blind assembly and comprises a male plug that is mounted on an interior wall of an instrument panel and a female socket that is attached to an electrical component so that the female socket plugs onto the male plug when the electrical component is mounted on the instrument panel.

The male plug includes a platform and a flexible printed circuit that is wrapped about the platform with portions of its conductive strips exposed for electrical connection. The female socket connector houses a plurality of terminals that have resilient tongues that engage the exposed conductive portions of the flexible printed circuit when the female socket plugs onto the male plug. While this arrangement is satisfactory for its intended purpose and facilitates blind assembly, the flexible printed circuit limits the number of times that the female socket of the electrical connection system can be disconnected and reconnected with the male plug.

SUMMARY OF THE INVENTION

The object of this invention is to provide an electrical connection system useful for connecting visual or manually operable electrical devices mounted on a panel to an electrical circuit behind the panel that facilitates blind assembly but that does not require the use of a flexible printed circuit.

A feature of the invention is that the electrical connection system has a male plug that uses a plurality of metal terminals and consequently the female socket can be disconnected and reconnected repeatedly without diminishing the effectiveness of the electrical connection to any significant degree.

Another feature of the invention is that the electrical connection system has a male plug that uses metal terminals that are sturdy and damage resistant.

Another feature of the invention is that the electrical connection system has a male plug that uses metal terminals that have smooth contact surfaces for engaging terminals of the female socket.

Another feature of the invention is that the electrical connection system has a male plug that has flexible lock arms for retaining the metal terminals that are located inside the metal terminals to avoid damage during shipment and handling.

Yet another feature of the invention is that the electrical connection system has a male plug that simulates a printed circuit male plug that has a flexible printed circuit wrapped about a stiff platform such as disclosed in the Kidd et al. '329 patent discussed above or a self-supporting hardboard printed circuit portion.

Still another feature of the invention is that the electrical connection system has a male plug that is compatible with a printed circuit type female socket, such as the female socket disclosed in the Kidd et al. '329 patent discussed above thereby avoiding the expense of designing and tooling a special female socket.

These and other objects, features and advantages of the invention will become more apparent from the following description of a preferred embodiment taken in conjunction with the accompanying drawing.

DESCRIPTION OF THE PREFERRED EMBODIMENT

Figure 1:
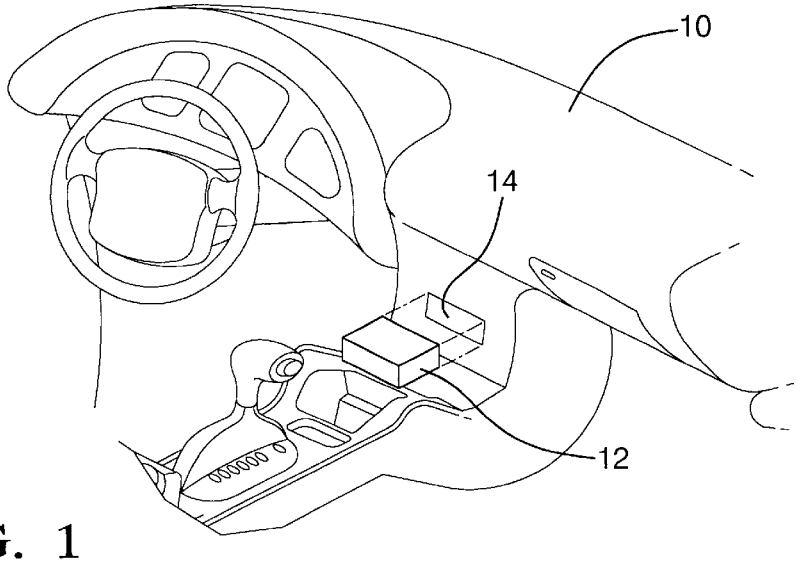
FIG. 1 is a perspective view of an interior of an automobile having an instrument panel equipped with an electrical connection system of the invention is installed.

Referring now to FIG. 1, an interior of an automobile includes an instrument panel 10 which includes several electrical devices including an electrical device 12 that is mounted on the instrument panel 10 by sliding the electrical device into a receptacle 14 that is open at the front of the instrument panel 10.

This invention provides an electrical connection system that is useful for connecting the electrical device 12 to an electrical circuit located behind the instrument panel 10. Moreover, the invention has a blind assembly capability so that the electrical device 12 is automatically connected to the electrical circuit when the electrical device is inserted into the receptacle 14 and fastened in place.

Figure 3:
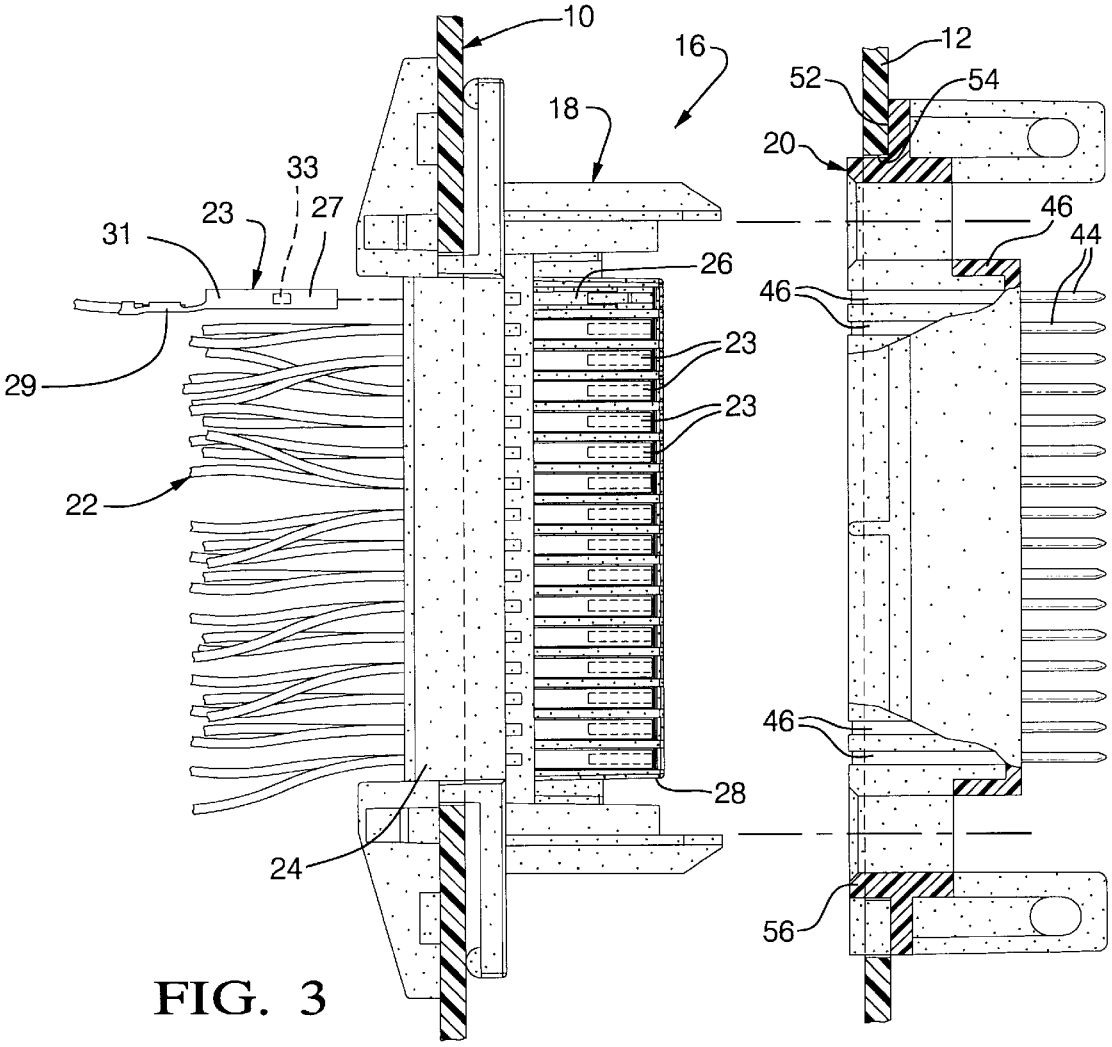
FIG. 3 is a top view of the electrical connection system that is shown in FIGS. 2.
Figure 2:
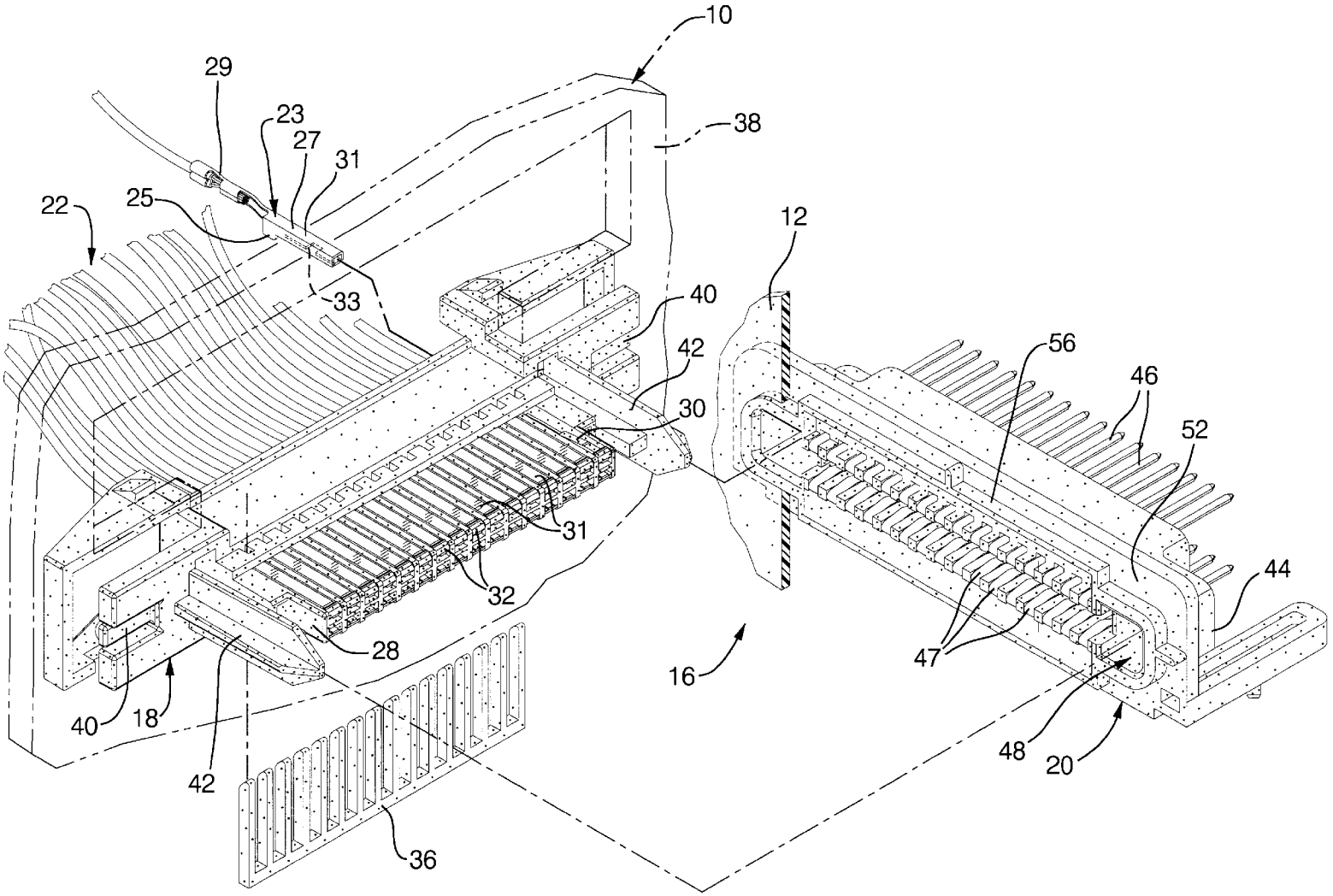
FIG. 2 is an exploded perspective view of the electrical connection system that is used in the instrument panel shown in FIG. 1.
Figure 4:
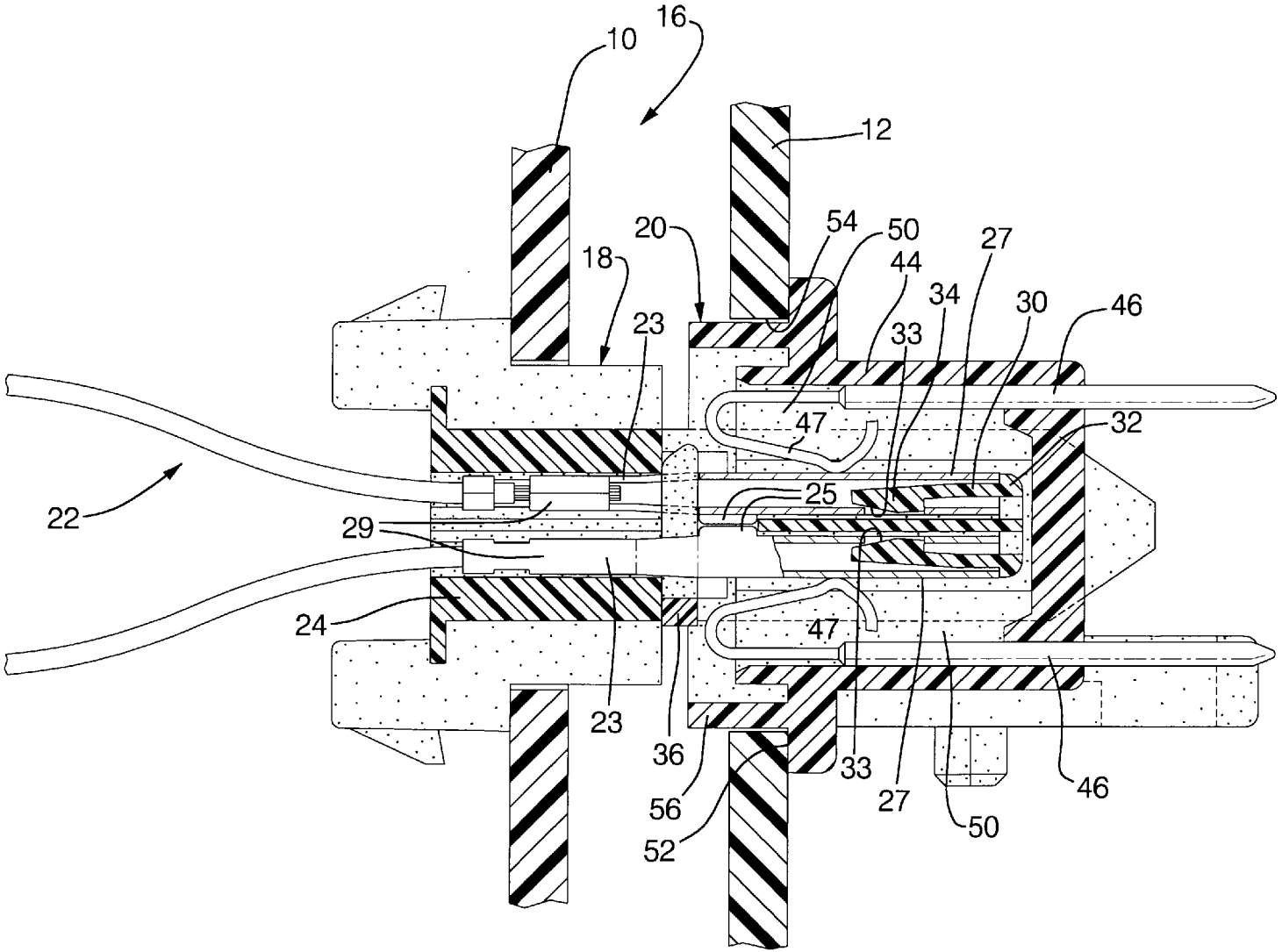
FIG. 4 is a side sectional view of the electrical connection system that is shown in FIGS. 2 and 3.

The electrical connection system of the invention which is indicated generally at 16 in FIGS. 2, 3 and 4 comprises a male plug 18 and a female socket 20.

The male plug 18 is attached to an end of a wiring harness 22 that is located behind the instrument panel 10 and the receptacle 14. The wiring harness 22 is part of an electrical circuit that is behind the instrument panel 10 for connecting the several electrical components mounted on the instrument panel 10 into the electrical circuit of the automobile in well known manner.

The male plug 18 comprises a nonconductive connector body 24 that is usually molded of a plastic material and a plurality of metal terminals 23 that are attached to the ends of individual electrical wires of the wiring harness 22. Terminals 23 are disposed in a plurality of terminal cavities 26 that extend through the connector body in a longitudinal direction from the rearward end to the forward end of the connector body. The connector body has a platform 28 at the forward end. The terminal cavities 26 are preferably arranged in two rows to increase terminal density. Each terminal cavity 26 is rectangular in the rearward end of the connector body 24 and channel shaped in the platform 28 at the forward end so that the terminal cavities 26 have an open side at the exterior of the connector body 24 for exposing contact portions of the metal terminals 23 as explained below.

The connector body 24 includes a plurality of flexible arms 30 for retaining the metal terminals 23 in the terminal cavities 26. The flexible arms 30 are integrally attached to the connector body 24 at the front end by bridges 32 that span the side walls of the terminals and include a forward stop shoulder. The flexible arms 30 extend rearwardly from the bridges 32 in cantilever fashion and have hooks 34 at their free ends as best shown in FIG. 4.

The metal terminals 23 have tubular contact portions 27 at a forward end and wire attaching portions 29 at a rearward end. The tubular contact portions 27 are preferably rectangular in cross section and formed by rolling a flat portion of terminal stock (not shown) into a rectangular tube. The rectangular tube is preferably rolled so that the seam is located at an inside corner of the terminal cavity 26. Thus the rectangular tube or contact portion 27 has an exterior side 31 that provides a smooth flat contact surface that does not have any sharp edges for contacting terminals of the female socket 20. The contact portion 27 includes a lock aperture 33 in the interior side of the rectangular tube that is opposite the exterior side 31.

The metal terminals 23 are properly oriented by means of indexing tabs 25 and then inserted into the rearward ends of the terminal cavities 26 until the terminals 23 engage the forward stop shoulders of bridges 32. Terminals 23 are then retained in the terminal cavities 26 by the flexible lock arms 30. These flexible lock arms 30 extend through the open front ends of the terminals 23 into the interior of the tubular contact portions 27 of the terminals 23 in cantilever fashion with the hooks 34 at the free ends engaging the edges of the lock apertures 33, as best shown in FIG. 4. When installed, the exterior sides 27 of the metal terminals 23 project outwardly of the platform 28 through the open sides of the terminal cavities 26 as best shown in FIG. 2.

The male plug 18 also includes has a terminal position assurance device in the form of a comb 36 that is inserted crosswise into the connector body 24 with each tooth of the comb 36 extending through cross holes and positioned behind the contact portions 27 of two aligned metal terminals 23 as best shown in FIG. 4.

The male plug 18 is attached to a wall 38 of the instrument panel 10 at the back of the receptacle 16. For this purpose, the wall 38 has a T-shaped slot. The connector body 24 is first inserted longitudinally into the wider upper portion of the T-shaped slot and is then pushed down into the narrower lower portion. Both sides of the connector body 24 have forward flanges and rearward flanges that engage opposite sides of wall 38 adjacent the lower narrow portion of the T-shaped slot. Each forward flange includes a compliant finger 40 having a rearward facing ball that engages wall 38 to ensure that the connector body 24 is retained in the installed position unless it is intentionally removed.

Both sides of the connector body 24 also have alignment posts 42 that project forwardly of the platform 28. Alignment posts 42 have vertical tapered surfaces and transverse or horizontal tapered surfaces at the forward end for guiding the female socket 20 onto the male plug 18.

The female socket 20 comprises a nonconductive connector body 44 and a plurality of compliant metal terminals 46. Connector body 44 has a central slot 48 for receiving the alignment posts 42 and the platform 28 of the male plug 18 and a plurality of terminal cavities 50 that are arranged in two rows on opposite sides of the slot 48. The forward portions of terminal cavities 50 are channel shaped with an open interior side that communicates with slot 48. Each of the compliant metal terminals 46 has a flexible tongue 47 at the forward end that projects into the slot 48 for contacting a metal terminal 23 of male plug 18 when the female socket 20 is plugged onto the male plug 18.

The female socket 20 is mounted inside the electrical device 12 with a face portion 52 of the connector body 44 adjacent an inside surface of an end wall of the electrical device 12 that has a suitable aperture 54 that provides plug-in access to the female socket 20. Connector body 44 preferably includes a short shroud 56 on face portion 52 that fits into the access hole. Terminals 46 have tails 58 that fit tightly in holes in the back wall of connector body 44 and project rearwardly of the back wall for connection to a printed circuit board or flexible printed circuit in the electrical device 12. Female socket 20 is a printed circuit type socket, that is designed to receive a hard board printed circuit portion in slot 48 or a flexible printed circuit wrapped about a platform such as illustrated in the Kidd et al. '329 patent discussed above.

Obviously, many modifications and variations of the present invention in light of the above teachings may be made. It is, therefore, to be understood that, within the scope of the appended claims, the invention may be practiced otherwise than as specifically described.

I claim:

1. An electrical connection system for connecting an electrical device mounted on a panel to an electrical circuit located behind the panel comprising:

a male plug having a nonconductive connector body having a plurality of terminal cavities and a plurality of metal terminals disposed in respective ones of the terminal cavities, the connector body having a plurality of flexible arms for retaining the metal terminals in the terminal cavities, the flexible arms being integrally attached to the connector body and extending rearwardly into the terminal cavities in cantilever fashion and wherein the connector body of the male plug has a platform at a forward end and the terminal cavities have channel shaped portions in the platform that have open exterior sides for exposing contact portions of the metal terminals, and wherein the metal terminals have tubular contact portions at a forward end and the flexible lock arms project into the tubular contact portions of the metal terminals in cantilever fashion, and wherein the tubular contact portions are rectangular in cross section and have sides that project outwardly of the platform through the open exterior sides of the terminal cavities to provide flat contact surfaces, the tubular contact portions having the lock apertures in sides opposite the sides that project outwardly of the platform, the lock apertures receiving the flexible arms therein to retain the metal terminals in the terminal cavities, and wherein the terminal cavities of the male plug are arranged in two rows and further including a female socket comprising a nonconductive connector body and a plurality of compliant metal terminals, the connector body of the female socket having a central slot for receiving the platform at the forward end of the male plug and a plurality of terminal cavities on opposite sides of the central slot for receiving respective ones of the plurality of compliant metal terminals, each of the compliant metal terminals having a first substantially straight portion and a second portion including a flexible tongue that is bent back over the straight portion so that the tongue projects into the slot for contacting a metal terminals of the male plug when the female socket is pluged onto the male plug.

2. The electrical connection system as defined in claim 1 wherein the tubular contact portions have single seams that are remote from the sides that project outwardly of the platform so that the flat contact surfaces have smooth edges.

3. The electrical connection system as defined in claim 2 wherein the metal terminals have wire attaching portions at a rearward end.

4. The electrical connection system as set forth in claim 1 wherein the flexible arms are integrally attached to the connector body at the front end by bridges that span the side walls of the terminals and include a forward stop shoulder for the terminals.

5. The electrical connection system as set forth in claim 4 wherein the flexible arms extend rearwardly from the bridges in cantilever fashion and have hooks at the free ends for engaging the locking apertures.

* * * * *